US005779370A

United States Patent [19]

Schroeder et al.

[11] Patent Number: 5,779,370

[45] Date of Patent: Jul. 14, 1998

[54] APPARATUS FOR PRINTING LABELS AND A SELF-RELEASING PRINT ROLLER THEREFOR

[75] Inventors: Karl Siegfried Schroeder, Clayton; Nigel G. Mills, Kettering; William Howard McMahon, Ludlow Falls, all of Ohio

[73] Assignee: Premark FEG L.L.C., Wilmington, Del.

[21] Appl. No.: 682,317

[22] Filed: Jul. 17, 1996

Related U.S. Application Data

[60] Provisional application No. 60/011,934 Feb. 20, 1996.

[51] Int. Cl.[6] ..... B41J 2/325; B65H 29/54

[52] U.S. Cl. ..... 400/120.01; 271/308; 271/900; 101/375

[58] Field of Search ..... 400/321, 611, 400/120.01, 118.1; 101/226, 288, 357; 271/900, 306, 307, 308, 311, 312, 313

[56] References Cited

U.S. PATENT DOCUMENTS

| | | | |
|---|---|---|---|
| 2,348,355 | 5/1944 | Miller | 271/900 |
| 3,955,889 | 5/1976 | Ishiguro et al. | 355/3 R |
| 4,285,507 | 8/1981 | Marinoff | 271/3 |
| 4,487,158 | 12/1984 | Kayson | 118/60 |
| 5,130,758 | 7/1992 | Takeda et al. | 271/308 |
| 5,217,220 | 6/1993 | Carlson et al. | 271/303 |
| 5,245,923 | 9/1993 | Vrotacoe | 101/217 |
| 5,368,291 | 11/1994 | MacNiel | 271/308 |
| 5,405,482 | 4/1995 | Morrissette et al. | 156/364 |
| 5,427,460 | 6/1995 | Kajiya | 400/118.1 |
| 5,437,228 | 8/1995 | Uland | 101/288 |
| 5,487,337 | 1/1996 | Uland | 101/288 |
| 5,497,701 | 3/1996 | Uland | 101/288 |
| 5,507,226 | 4/1996 | Burke et al. | 101/375 |
| 5,518,781 | 5/1996 | Nakamura | 271/313 |
| 5,544,584 | 8/1996 | Thompson et al. | 101/401.1 |
| 5,560,293 | 10/1996 | Boreali et al. | 400/621 |

FOREIGN PATENT DOCUMENTS

| | | | |
|---|---|---|---|
| 0637547 | 8/1995 | European Pat. Off. . | |
| 2139326 | 5/1990 | Japan . | |
| 0269193 | 10/1950 | Switzerland | 271/312 |
| 163696 | 5/1921 | United Kingdom | 271/307 |

*Primary Examiner*—Eugene H. Eickholt
*Attorney, Agent, or Firm*—Thompson Hine & Flory LLP

[57] ABSTRACT

An apparatus for printing labels having a tacky side and a non-tacky printable side. The apparatus comprises a print head for printing indicia on the printable side of the labels, and a print roller disposed in close proximity to the print head. The print head is thus enabled to print indicia on the labels when the labels are supported by the print roller, the print roller having at least one annular recess in its surface thereof. The apparatus further comprises at least one elongated stripper element retained in and extending from the recess such that upon rotation of the roller, the label is transported to the stripper element. The stripper element thereby lifts the label from the surface of the roller and the label is removed from the print roller.

22 Claims, 4 Drawing Sheets

APPARATUS FOR PRINTING LABELS AND A SELF-RELEASING PRINT ROLLER THEREFOR

This application claims priority of U.S. Provisional Application Ser. No. 60/011,934, filed Feb. 20, 1996.

BACKGROUND OF THE INVENTION

The present invention relates to an apparatus for printing merchandising labels such as those used on packages of food and other products; more particularly, the invention relates to printing and dispensing linerless labels specifically, a means for removing a linerless label from the surface of a print roller to prevent the label from becoming jammed in the printer. Also provided is a self-releasing print roller system for use in a label printer which is useful with linerless labels.

In product merchandising, such as in the retail food business, products are typically wrapped, weighed and labeled to provide price, quantity and or other information about the product. Label stock is supplied in two forms, namely linered and linerless. Typically the labels are made from thermosensitive paper and have an adhesive backing on them so that they will adhere to the wrapper. Linered labels are supplied on a continuous release liner such as a paper coated on one side with silicone. A major disadvantage of using conventional linered label stock is that the spent liner must be collected and discarded. This typically involves providing a take-up reel inside the printer.

Linerless label stock is supplied without a silicone-coated backing paper. Instead, the labels are coated on their printable side with a non-stick material such as silicone so that their adhesive side will not stick appreciably to the print side when wound in roll form. However, linerless label stock is often inconvenient to use because the adhesive contacts and adheres to the conveying elements as the label stock is transported through the printer. This can be a particular problem if a thermal print head is used in the printer because the print head presses against the label which in turn presses and adheres the label to the print roller. If the label adheres too strongly to the print roller it is not unusual for the label to become jammed between the print roller and the pick, guide or other means used in the printer to remove the label from the roller.

U.S. Pat. No. 5,437,228 to Uland and European Patent No. 637,547 both teach an apparatus for printing linerless labels. In order to prevent the labels from adhering to the printing mechanism, the labels are transported through the printer on an endless belt which is formed from or coated with a release material. The belt encompasses the print roller. While this represents an improvement, it does not completely solve the problem in that labels may adhere to the belt anyway. Further, the belts can be damaged easily.

U.S. Pat. No. 5,497,701 also to Uland teaches a printer having a generally planar pick which is mounted parallel to and adjacent the print roller. The pick is made of plastic and has a plurality of grooves therein which extend downstream away from the print roller. The pick strips the leading portions of the label from the print roller. There are disadvantages to using such a pick. The labels can adhere to it, especially if left to sit overnight. In addition, the labels can occasionally become jammed between the print roller and the pick, and the spacing tolerance between the pick and the roller is difficult to set and maintain.

SUMMARY OF THE INVENTION

In accordance with the invention, a printer is provided which includes a print roller having an annular recess and at least one stripper blade which is mounted in the recess in the roller. As the print roller rotates, the label is carried under the print head where it is printed and then moved to the stripper blade which lifts the label from the surface of the print roller and directs the label to an exit slot in the printer. Because the stripper blade extends from a point in the recess in which it underlies the label to a point above the surface of the roller, the label is readily and reliably removed from the roller. Further, due to the material of the print roller, the size of the recess, and the size and position of the stripper blade, the recess does not affect the quality of the printing on the label.

Accordingly, it is an object of the present invention to provide an apparatus for printing linerless labels in which the label is easily removed after contacting the surface of the print roller. A novel print roller construction is also provided.

The printer preferably comprises a roller having a self-releasing surface for receiving a tacky side of a label, at least one recess in said surface and at least one stripper blade extending at least partially into the recess. The stripper blade is adapted to lift and direct the label away from the surface of the roller as the roller is rotated.

Further, an apparatus for printing labels having a tacky side and a non-tacky printable side is provided comprising a print head for printing indicia on the printable side of the labels; a print roller disposed in close proximity to the print head, the print roller is positioned to hold the printable side of the labels adjacent the print head and includes at least one recess therein; and at least one stripper blade extends into the recess and is adapted to lift and direct the label away from the surface of the print roller as the roller is rotated. This apparatus can also be used for linered labels with the addition of a take-up reel.

It is still another object of the present invention to provide a dual durometer print roller for a label printer wherein a first annular, harder material is mounted on the axle and a second annular, softer material is coaxially supported on the first material.

Other objects and advantages of the present invention will be apparent from the following description, the accompanying drawings and the appended claims.

BRIEF DESCRIPTION OF THE DRAWING

The invention will now be described in detail with respect to the following figures.

DETAILED DESCRIPTION OF THE PREFERRED EMBODIMENTS

The printing apparatus of the present invention can be used in a variety of applications. It will be understood by the skilled artisan that the printer can be constructed independently as a stand alone or hand held unit or the printer can be incorporated as a component of other devices.

Figure 1:
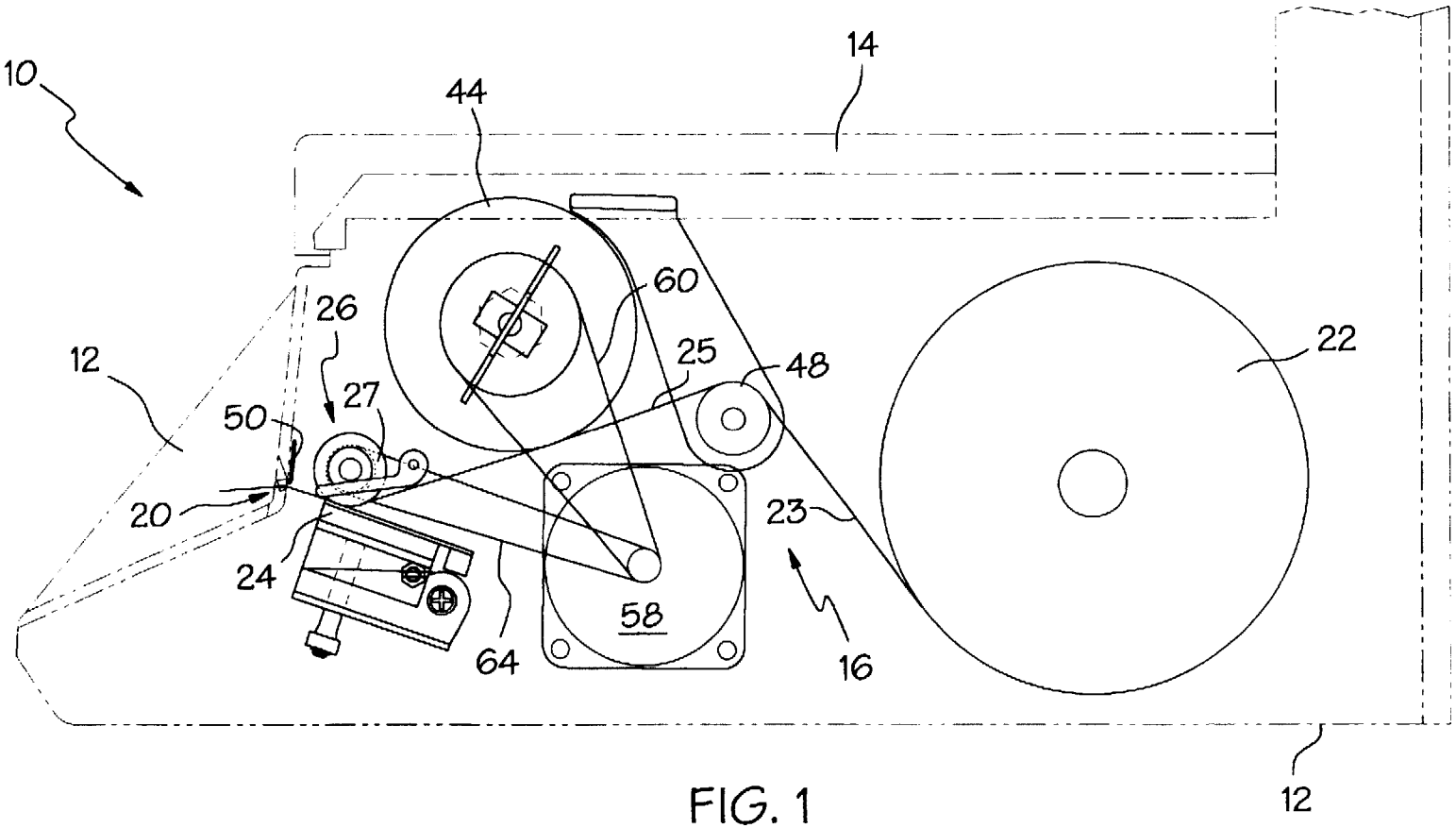
FIG. 1 is cross-sectional view of scale incorporating a label printing apparatus in accordance with one embodiment of the present invention for use with linerless label stock.

FIG. 1 illustrates a scale which is generally designated 10 which incorporates a printer 16 in accordance with the invention. The scale 10 includes a housing 12 and a platter 14 which have a conventional construction and are shown herein to provide a frame of reference in which to illustrate and explain the use and operation of the printer. The label printer 16 includes a slot 20 through which the printed labels are dispensed from the printer.

The label printer 16 of the present invention is designed for using linerless label stock, but one feature of the design that is illustrated in the drawings is that the printer will also accommodate linered stock. The invention will be illustrated using linerless stock.

The label stock is provided on a roll 22 which is removably mounted within the printer 16. The label stock has a printable side 23 which is capable of being marked with indicia by a print head 24 or other printing means, and a tacky side 25 which is capable of adhering the label to a product.

The printer 16 includes a print roller assembly designated 26. As shown in detail in FIGS. 2-4, the print roller assembly 26 includes a print roller 27 which is driven on axle 28 and at least one stripper blade 32. While theoretically only one stripper blade is required to remove the label from the print roller, it is generally preferred to use a plurality of blades. In the embodiment illustrated in FIG. 4, two blades are used, but in other embodiments three or more blades could be used depending upon the width of the print roller. The distance between the blades depends on the tackiness of the labels, the material of the roller and the tendency of the labels to stick to the roller. As a general rule, it is desirable not to space the blades too far apart, since the label may bow in between the blades and could collide with the opening as the label attempts to exit the printer. The surface 30 of the print roller 27 is preferably formed from an elastomeric, self-releasing material which exhibits minimal adhesion with the tacky side 25 of the labels. The term "self-releasing surface" means a surface which presents enough release that the labels can be lifted from the surface by the stripper blade as described herein.

The stripper blade(s) lift and separate the label from the surface of the roll thereby preventing the label from becoming jammed in the printer. One advantage that this stripper system provides is that it allows greater flexibility in choosing the material for the print roller and the label stock because the stripper blade is able to remove labels with a minor, but by comparison to other printers, significant degree of adhesion to the print roller without jamming.

Figure 2A:
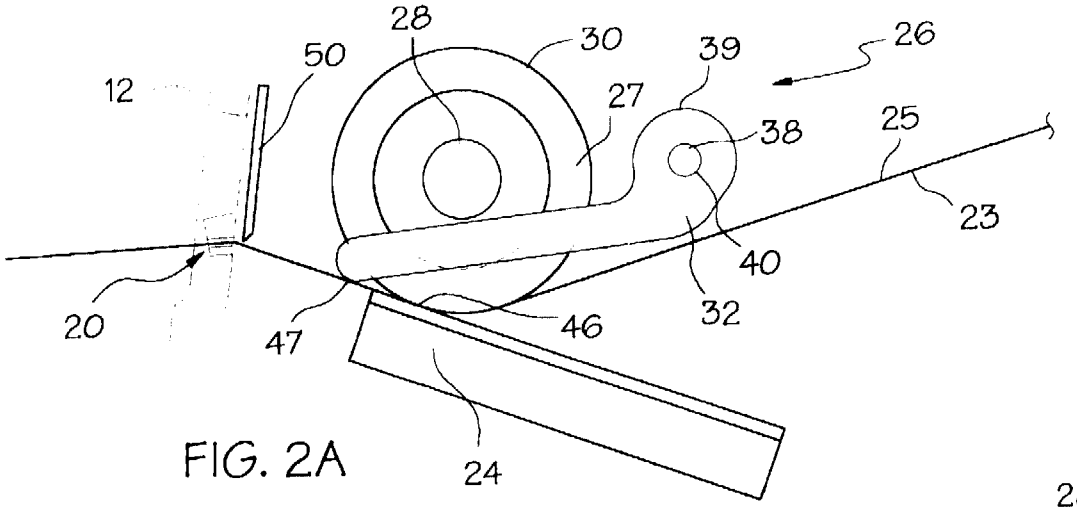
FIG. 2A is a detailed side view showing the print roller assembly.
Figure 2C:
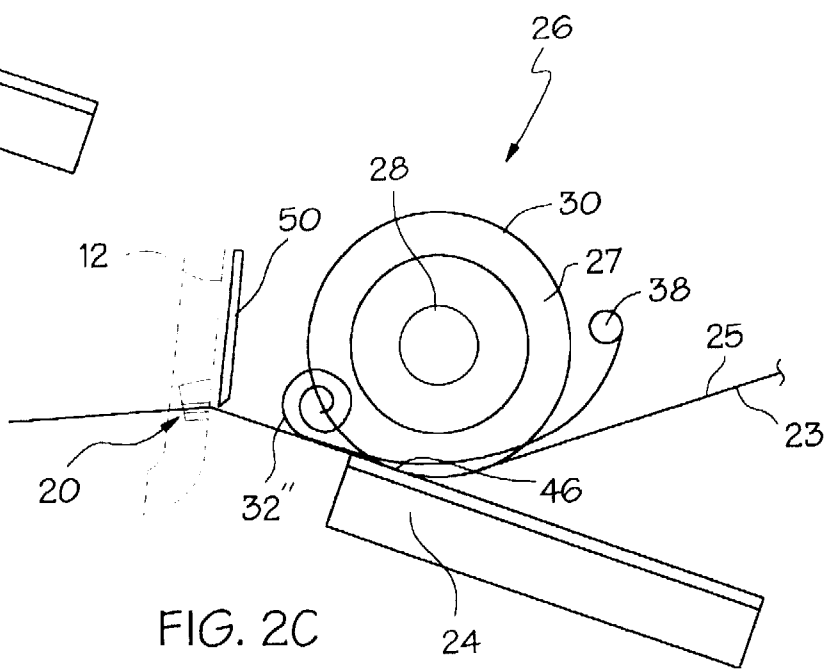
FIG. 2C is a side view showing another embodiment of the invention.

The stripper blade 32 can be formed from a variety of materials. The stripper blade must be made from a material that is thin enough to ride in recesses of the roller and rigid enough to separate the label from the surface of the print roll. It has been found particularly desirable to cut the blades from 10 mil polyester film such as polyethylene terephthalate sold under the tradename Mylar by DuPont. However, if a more rigid material is used, the blade can be thinner, such as a 5 mil thick stainless steel blade. Those skilled in the art will be able to select other materials that could be used including other metals or plastics and the like. FIG. 2C illustrates an embodiment in which a metal wire is used.

In designing the stripper blade and selecting the material from which it is made, an important consideration is the width of the recesses in the print roller. These recesses should not be so wide that they interfere with printing of the label. In particular, in using a thermal print head, the label must be held in contact or close proximity to the print head such that the heat emitted by the print head is not dissipated but heats the label to a temperature at which the heat sensitive coating on the surface of the label reacts to form an image. Preferably the recesses are as narrow as possible, for example, about 10 to 16 mils wide. The recess must be deep enough that the stripper blade does not rise above the surface of the print roll on the print line under the print head. Otherwise, the stripping blade may interfere with printing. As explained and illustrated below with reference to FIGS. 6A–6C, the stripping blade can be level with the surface of the roll to provide a uniform flat support to the label during printing, but good print quality is also obtained when the blade is recessed below the surface of the print roll at the printing location.

Figure 6A:
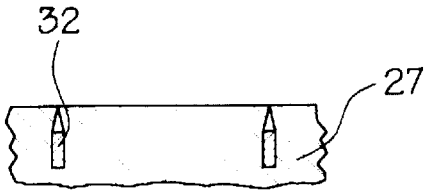
FIG. 6A, 6B, and 6C illustrate schematically the relationship of the stripper blade and the surface of the print roller.
Figure 6B:
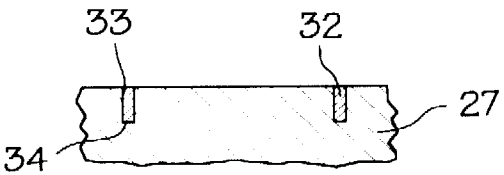

FIGS. 6A and 6B schematically illustrate the relationship between the stripper blade 32 and the surface 30 of print roller 27. If the surface portion of the print roll 27 is formed of a relatively soft rubber, under the lineal pressure of the print head, the surface of the roller will close the recess over the blade 32 thereby providing an essentially uniform heat insulative surface to back up the label during printing. Alternatively, as shown in 6B, the upper edge of the stripper blade 32 can be aligned with the top 33 of the recess 34 so as again to provide a uniform back up surface for the label during printing.

Figure 6C:
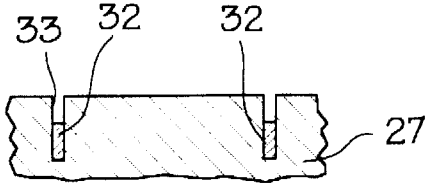

While the blade arrangements in FIGS. **6*a* and 6*b* are desirable, they may be more expensive and more difficult to manufacture due to the materials used or the alignment that must be accomplished. FIG. 6C illustrates a more typical embodiment wherein the blades 32 are recessed below the surface of the roller 27**. This arrangement is satisfactory provided that the recesses are narrow enough that they do not interfere with printing.

Figure 2B:
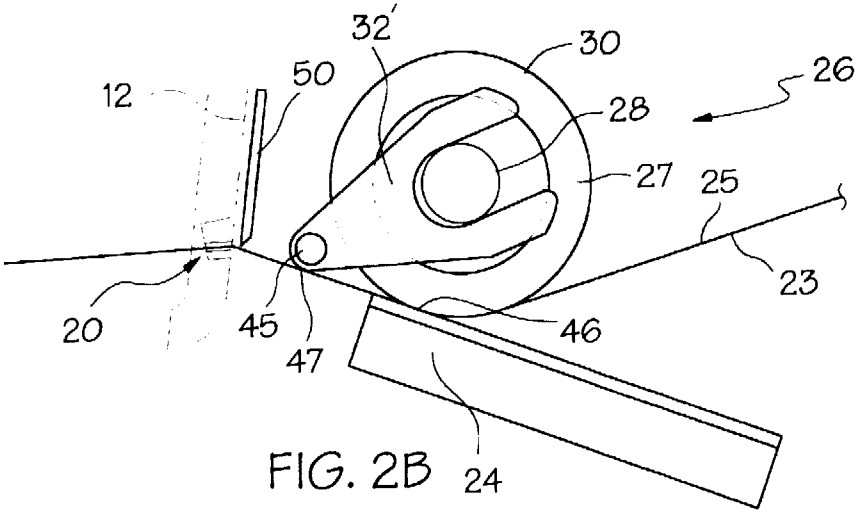
FIG. 2B is a side view showing an alternative embodiment of the invention.

The stripper blade can have various designs. FIG. 2A illustrates an embodiment in which the stripper blade is an elongated finger, FIG. 2B illustrates an embodiment in which it is a fork, and FIG. 2C illustrates a further embodiment in which the blade is a wire including a spiral spring. To anchor the blades in the printer, a hole can be provided in one end of the blades and an alignment or attachment bar 38 is mounted in the printer which passes through the hole in the end of the blade. The stripper blade preferably has a width of about 0.015 inches or less so that there is minimal surface area for adhesion of the label and the stripper blade produces less drag on the print roller as it is turned. The stripper blade 32 includes an edge 47 of the stripper blade 32 which extends beyond the perimeter of the print roller 27 downstream of the printhead in order to lift the label. The blades are preferably aligned with the exit slot in the printer so as to direct the label through the opening 20, for example and out of the printer. The angle of the stripper blade or its edge 47 may also be adjusted to ensure that the label is directed toward the desired egress, tear or cut location. The blades could extend into and through the opening 20 if desired.

The stripper blade attachment bar is mounted to the printer frame 52 either upstream from the print roller as shown as bar 38 in FIG. 2A or downstream from the print roller as shown as bar 45 in FIG. 2B, and holds the stripper blade(s) in position as the print roller rotates. FIG. 2B shows an embodiment wherein the stripper blade 32 is fork shaped and is mounted downstream of the print head. The bar 45 is attached to frame 52 and passes through hole 40 in the stripper blade. In cases in which the bar 45 contacts the labels or a liner, the bar may include a lubricating or nonstick coating 42 to prevent the tacky portion 25 of the label from sticking to it. In a preferred embodiment, the coating 42 has a non-adhering surface. When using linered label stock, the attached bar 45 also acts as a peel bar to peel the liner away from the label and to redirect the liner towards an optional take-up reel 44 shown in FIG. 1.

FIG. 2C shows a third embodiment wherein the stripper blade 32 is a wire such as one wire in a wire comb having several wires. The wire can include a spiral spring portion which extends into the recess and biases the distal end of the spring into contact with the labels. In an alternative embodiment that is not illustrated in the drawings, the wire may encircle the axle of the print roll and extend tangentially outwardly from the axle. A pin can be provided to hold the wire (which in this case is essentially straight but for the portion encircling the axle) in position and prevent it from rotating as the print roller is turned. The stripper wire may also be cantilevered or spring-biased.

Figure 3:
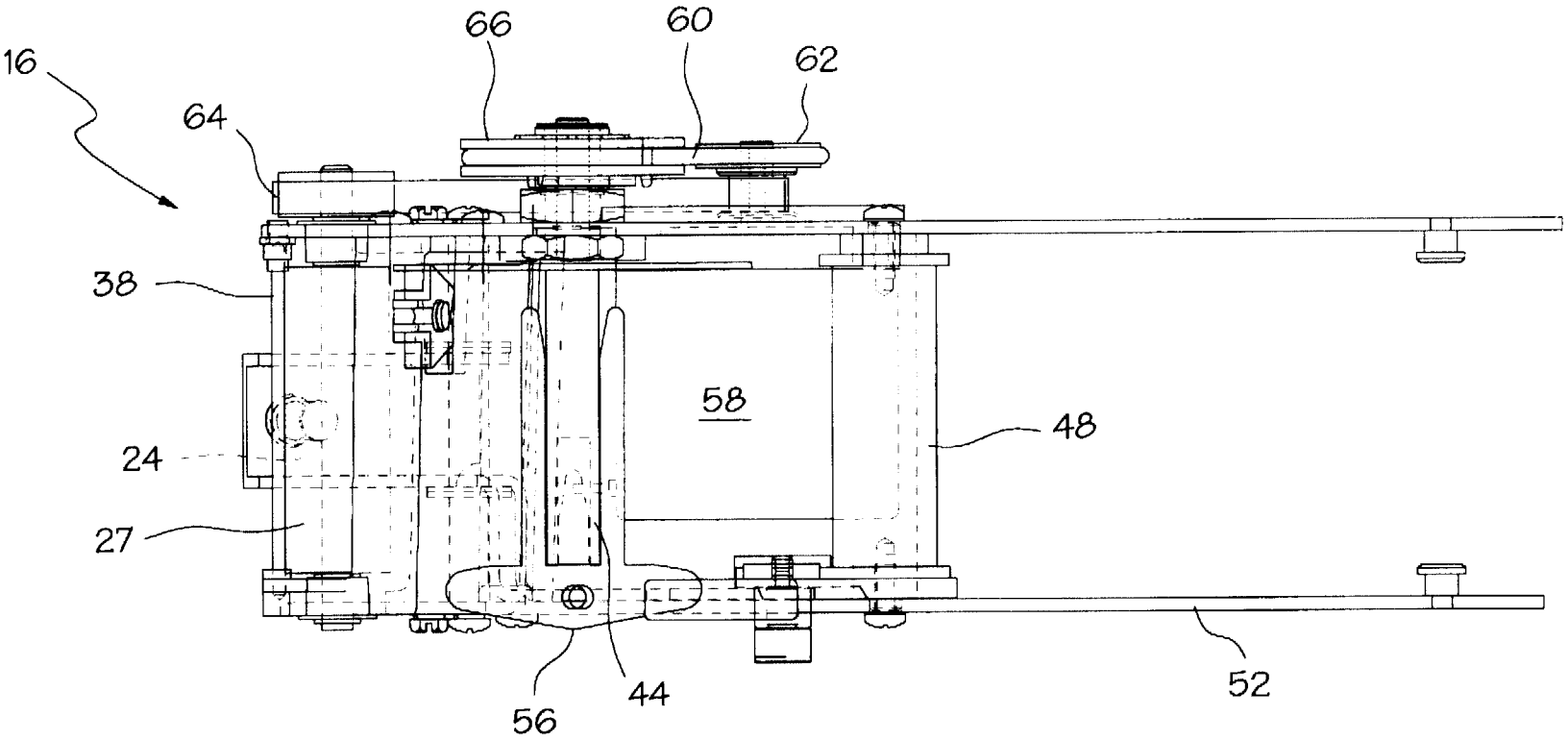
FIG. 3 is an overhead plan view of the printer roller assembly portion of the printing apparatus.
Figure 4:
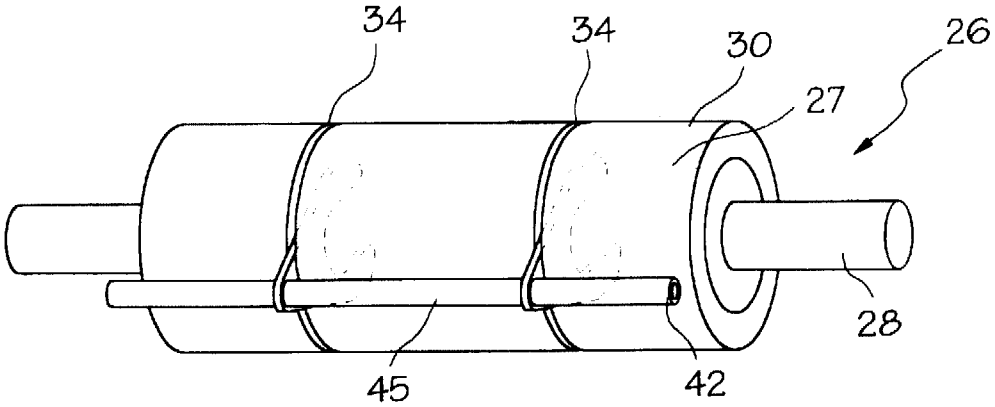
FIG. 4 is a schematic front view of the print roller and stripper blade assembly.

FIG. 3 shows the top view of printer 16, within frame 52. The printer includes a idler roller 48 which acts as a guide for the labels, and an optional take-up reel 44 for linered stock. The take-up reel 44 includes a key 56 for securing the liner as it is being taken up. In addition, the printer includes stepper motor assembly 58 which drives the print roller via timing belt 64. Stepper motor assembly 58 also drives pulley 62 which drives the take up reel 44 through drive belt 60 and take-up pulley 66.

The printer 16 includes a conventional thermal print head 24 disposed in close proximity to the print roller 27. During printing, the print head 24 is biased into contact with the labels on the surface of the print roller 27 so as to apply a small lineal pressure to the print roller. Though a thermal print head is shown here, an ink jet or laser printer system may be used. The labels are conveyed through the printer by the print roller which is driven by the stepper motor 58. The operation of the print roller is coordinated with the print head so that the label is advanced after each time it is printed. The labels are directed by the stripper blades and/or the associated bar out of the slot opening 20 where a user can tear the printed label from the roll on the tear strip 50.

Figure 5:
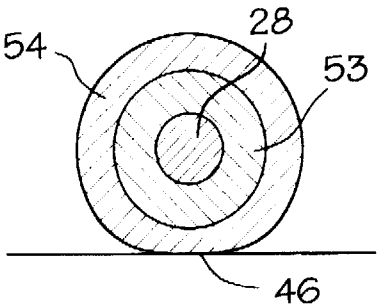
FIG. 5 is a cross-sectional view of a print roller useful in the invention.

As shown in FIG. 5, the print roller is preferably made from a material that is capable of being compressed under the small lineal pressure that is applied by the thermal print head 24. This flattens the surface of the roll in the vicinity of the print line making the print line slightly wider. It will be readily appreciated that this flattening permits more flexibility in aligning the print head with the print roller. The surface of the print roller is preferably made from a soft material, such as Dow HS2, a silicon material having a Shore A hardness of 10 or other equivalent soft elastomers such as urethane-elastomers. It will be appreciated that the harder the material on the surface of the printer roller is, the narrower the flattened surface is and the more carefully the print head must be aligned with the print roller.

It has been found that it is not desirable to form the entire print roller from the soft elastomers preferred for use on the surface of the print roller. If the entire print roller were made of such a soft elastomeric material, the print roller would tend to twist internally an unacceptable amount creating a torque which would compress the roller and distort the printed image.

As shown in FIG. 5, to prevent excess angular rotation and distortion of the print roller, a harder elastomer 53, such as Dow 3120 silicon having a Shore A hardness of 60, is used inside the roller on the axle 28 and the softer material 54 (previously described) is used on the outside surface of the roller. This is referred to as a dual durometer roller. This produces a torsionally rigid roller to reduce printing distortion due to torsion and compression of the soft outer material. In order to aid in bonding the inner material to the softer outer material the surface of the inner material may be roughened or secured with a bonding agent. The outer material is then molded to size using a teflon-coated mold. It has also been found that roughening the surface of the print roller aids in releasing the linerless label adhesive from the roller. The softer material may close over the stripper blade at the print line upon the application of pressure from the print head as shown in FIG. 6*a*, but the roller is sturdy enough for printing and transporting the label.

When the printer 16 is operated, the label stock 23 is fed from the supply roll 22 over a idler roller 48 to the print roller 27. In this embodiment, the print roller 27 is driven by the stepper motor 58 through a drive train including a pulley and belt system as described above. However, those skilled in the art will appreciate that the drive train design is not critical to the invention and other drive trains including gear trains can be used. Also, a roller other than the print roller could be driven, although this probably would add complexity and expense of the printer.

To summarize, when the label stock is fed between the print head 24 and print roller 27, the label temporarily adheres to the roller and the appropriate indicia is printed on the labels. The print side 23 of the label stock faces downwardly toward the print head 24 while the tacky side 25 of the label stock faces the print roller 27. The operation of the print head and the stepper motor are controlled so that the label is stopped, printed and advanced in a coordinated process which prints all the desired sales information on the label. As the label is advanced, by means of the print roller, the stripper blade 32 functions somewhat like a ramp which lifts the label 22 from the print roller 27. By appropriately aligning the stripper blade, the label can be directed toward the slot 20, where it is dispensed directly from the printer 16. A tear strip 50 is provided so that the labels can be torn from the remainder of the label stock for removal from the printer and the label is then attached to a product. The tear strip could be replaced by a knife or other cutting or separating mechanism.

The print roller discussed above has been described as having a recess. In place of an annular sleeve having recesses cut therein, a plurality of axially spaced annular sleeves of equal diameter may be utilized on the print roller axle. The spacing between the sleeves provides the recesses in which the stripper blades are located. Further, the axle itself may be provided with recesses therein.

The stripper assembly of the present invention, is so effective in removing labels from the surface of the print roller that the labels may remain adhered to the print roller overnight and can still be removed by the stripper blades the next day.

Having described the invention in detail and by reference to preferred embodiments thereof, it will be apparent that modifications and variations are possible without departing from the scope of the invention defined in the appended claims.

What is claimed is:

1. Apparatus for printing linerless labels having a tacky side and a non-tacky printable side, comprising:

a print head for printing indicia on said printable side of said labels;

a print roller disposed in close proximity to said print head such that said print head is able to print indicia on the labels when the labels are supported by said print roller, said print roller having at least one annular recess in the surface thereof;

and at least one elongated stripper element fixedly retained in and extending from said recess such that upon rotation of said roller, said label is transported to said stripper element and said stripper element lifts said label from said surface of said roller and said label is removed from said print roller.

2. The apparatus of claim 1 wherein said print roller includes an axle and an annular sleeve coaxially mounted on said axle, said sleeve having a self-releasing surface, said sleeve having said recess therein.

3. The apparatus of claim 1 wherein said labels are pressure-sensitive and said print head is a thermal print head.

4. The apparatus of claim 3 further comprising a stripper support bar, said bar being mounted stationarily and said stripper element being secured to said bar so that said stripper elements do not rotate with said print roller.

5. The apparatus of claim 4 wherein said bar is mounted upstream of said print roller.

6. The apparatus of claim 4 wherein said bar is mounted downstream of said print roller.

7. The apparatus of claim 4 wherein said bar has a release surface thereon.

8. The apparatus of claim 1 wherein said print roller is a dual durometer roller, having an inner material of a first harder material and an outer material of a second material softer than said first material.

9. The apparatus of claim 1 wherein said stripper element is an elongated member which extends from said recess in a direction downstream of said print head.

10. The apparatus of claim 1 wherein said stripper element is a blade that is sufficiently rigid to lift said label from the surface of said print roller.

11. The apparatus of claim 10 further comprising a stripper support bar, said bar being mounted stationarily and said stripper element being secured to said bar so that said stripper element does not rotate with said printer roller, and wherein said stripper element has a hole in one end and said stripper support bar passes through said hole.

12. The apparatus of claim 11 wherein said stripper blade is of a plastic film or metal sheet material.

13. The apparatus of claim 6 wherein said stripper element extends from said bar, through said recess in said print roller and downstream of said print roller towards an exit slot in said apparatus.

14. The apparatus of claim 4 wherein said stripper element has a fork shape, the prongs of said fork being positioned in said recess on opposite sides of said axle and said stripper element extends from said recess in a direction downstream of said print head toward an exit slot in said apparatus.

15. The apparatus of claim 12 wherein the stripper blade is a polyester film.

16. The apparatus of claim 1 wherein said stripper element has a width of less than 0.015 inches.

17. The apparatus of claim 3 wherein said stripper element is fixedly retained in said recess.

18. The apparatus of claim 3 wherein said elongated stripper element has an upper portion located upstream of the center of said print roller and a lower portion located downstream of the center of said print roller, said lower portion fixedly retained in said recess and located so as to contact said tacky side such that upon rotation of said roller said label is transported to said stripper element.

19. An apparatus for printing linered labels which are passed in a downstream direction and have a tacky side and a non-tacky printable side and are mounted to a removable liner, the apparatus comprising:

a print head for printing indicia on said printable side of said labels;

a print roller disposed in close proximity to said print head such that said print head is able to print indicia on said labels when said labels are supported by said print roller, said print roller having at least one annular recess in the surface thereof;

at least one elongated stripper element fixedly retained in and extending from said recess such that upon rotation of said roller, said label is transported to said stripper element and said stripper element lifts said label from said surface of said roller and said label is removed from said print roller; and a take up reel to collect said seperable liner.

20. The apparatus of claim 19 wherein said elongated stripper element has an upper portion located upstream of the center of said print roller and a lower portion located downstream of the center of said print roller, said lower portion fixedly retained in said recess and located so as to contact said tacky side such that upon rotation of said roller said label is transported to said stripper element.

21. The apparatus of claim 19 wherein said print head is a thermal print head and said stripper element is fixedly retained in said recess.

22. An apparatus for printing linerless labels which are passed in a downstream direction and have a tacky side and a non-tacky printable side, comprising:

a thermal print head for printing indicia on said printable side of said labels;

a print roller disposed in close proximity to said print head such that said print head is able to print indicia on the labels when the labels are supported by said print roller, said print roller having at least one annular recess in the surface thereof; and at least one elongated stripper element having an upper portion located upstream of the center of said print roller and a lower portion located downstream of the center of said print roller, said stripper element fixedly retained in said recess and located so as to contact said tacky side such that upon rotation of said roller, said label is transported to said stripper element and said stripper element lifts said label from said surface of said roller and said label is removed from said print roller.

* * * * *